United States Patent [19]

Ward

[11] 4,306,339

[45] Dec. 22, 1981

[54] POWER OPERATED PIPE SLIPS AND PIPE GUIDE

[76] Inventor: John F. Ward, P.O. Box #70, Fairview, Okla. 73737

[21] Appl. No.: 123,249

[22] Filed: Feb. 21, 1980

[51] Int. Cl.[3] ..... E21B 3/04

[52] U.S. Cl. ..... 24/263 DA; 24/263 D

[58] Field of Search ..... 24/263 R, 263 D, 263 DA, 24/263 DB, 263 DC, 263 DT, 263 CA

[56] References Cited

U.S. PATENT DOCUMENTS

| | | | |
|---|---|---|---|
| Re. 23,842 | 6/1954 | Moore | 24/263 DA |
| 2,034,101 | 3/1936 | Howard et al. | 24/263 DA X |
| 2,231,923 | 2/1941 | Koen | 24/263 DA |
| 2,810,552 | 10/1957 | Martin | 24/263 DA X |
| 2,822,670 | 2/1958 | Suderow | 24/263 DA X |
| 3,096,075 | 7/1963 | Brown | 24/263 DA X |
| 3,233,868 | 2/1966 | Harvey et al. | 24/263 DA X |
| 3,449,002 | 6/1969 | Bernard | 24/263 R X |
| 3,571,865 | 3/1971 | Johnson | 24/263 DA |
| 3,748,702 | 7/1973 | Brown | 24/263 DA |

*Primary Examiner*—Roy D. Frazier
*Assistant Examiner*—Peter A. Aschenbrenner
*Attorney, Agent, or Firm*—Robert K. Rhea

[57] ABSTRACT

A pipe or casing spider coaxially overies a base ring and is provided with a plurality of slips supported by a slip ring above the spider. The slip ring and slips are moved vertically by a plurality of pressure cylinders interposed between the base ring and slip ring. A support plate coaxially underlies the base ring and is provided with a radial latch tongue slidable toward and away from the axis of the spider for maintaining a tubular string coaxially aligned with the spider.

4 Claims, 6 Drawing Figures

POWER OPERATED PIPE SLIPS AND PIPE GUIDE

BACKGROUND OF THE INVENTION

1. Field of the Invention

The present invention relates to oil wells and more particularly to a power operated slip and pipe support apparatus.

2. Description of the Prior Art

Moore Pat. No. Re. 23,842 discloses a spider having a plurality of slips connected by linkage with an overlying slip ring moved vertically by a plurality of pressure cylinders operated by a remote control valve.

Johnson U.S. Pat. No. 3,571,865 discloses a power operated pipe and drill collar spider which features a radial slot in a support base permitting movement of the spider assembly toward and away from the axis of the rotary table.

This invention is distinctive over these patents by providing a centrally bored base plate coaxial with the spider and slips in which a laterally slidable latch tongue decreases the axial opening through the base plate and coaxially guides a tubular string through the spider to prevent accidental contact between the tubular string, or its components, and the slips.

SUMMARY OF THE INVENTION

A pipe or casing spider, having a generally conical seat, is coaxially supported by a base ring. A plurality of casing slips, movable into and out of the spider seat, grip tubular members when disposed therein and are pivotally connected by links with an overlying centrally bored slip ring. A plurality of pressure cylinders surround the spider in spaced-apart relation between the base ring and slip ring for moving the latter and the slips vertically in response to applied fluid pressure. A two-way fluid pressure valve, mounted on the outer wall surface of the spider and interposed in the pressure cylinder supply lines, may be manually opened and closed by a lever pivotally supported by the spider and connected with the two-way valve for manual actuation of the slip ring and slips by the pressure cylinders. The pivoting lever is normally biased to a closed position of the two-way valve. A centrally bored support plate coaxially underlies the base ring in a spider assembly levelling action on a rig floor, or the like, and is provided with an upwardly open radial groove intersecting its axial bore. A latch tongue is slidably received by the groove and movable in a radial direction toward and away from the support plate bore for reducing the diameter thereof when the tongue is moved inwardly relative to the support plate for surrounding and coaxially guiding a tubular string passing through the spider assembly.

The principal object of this invention is to provide a spider and slip assembly in which the slips are power actuated toward and away from a pipe gripping position and including a support plate having tongue means which will maintain a tubular string coaxial with the casing spider to prevent accidental damage to the slips and in which the tongue means may be moved laterally of the support plate and overlying spider and slip assembly.

DESCRIPTION OF THE PREFERRED EMBODIMENT

Figure 1:
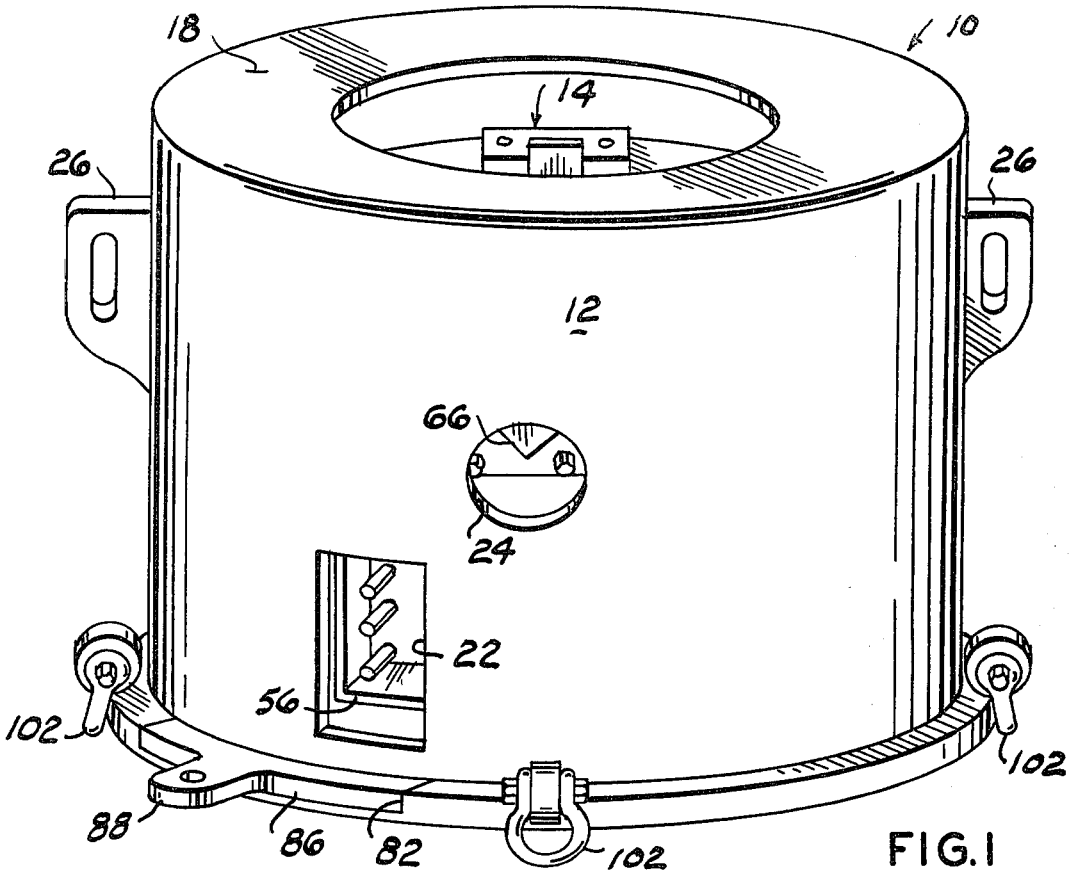
FIG. 1 is a perspective view of the device in operative position.
Figure 2:
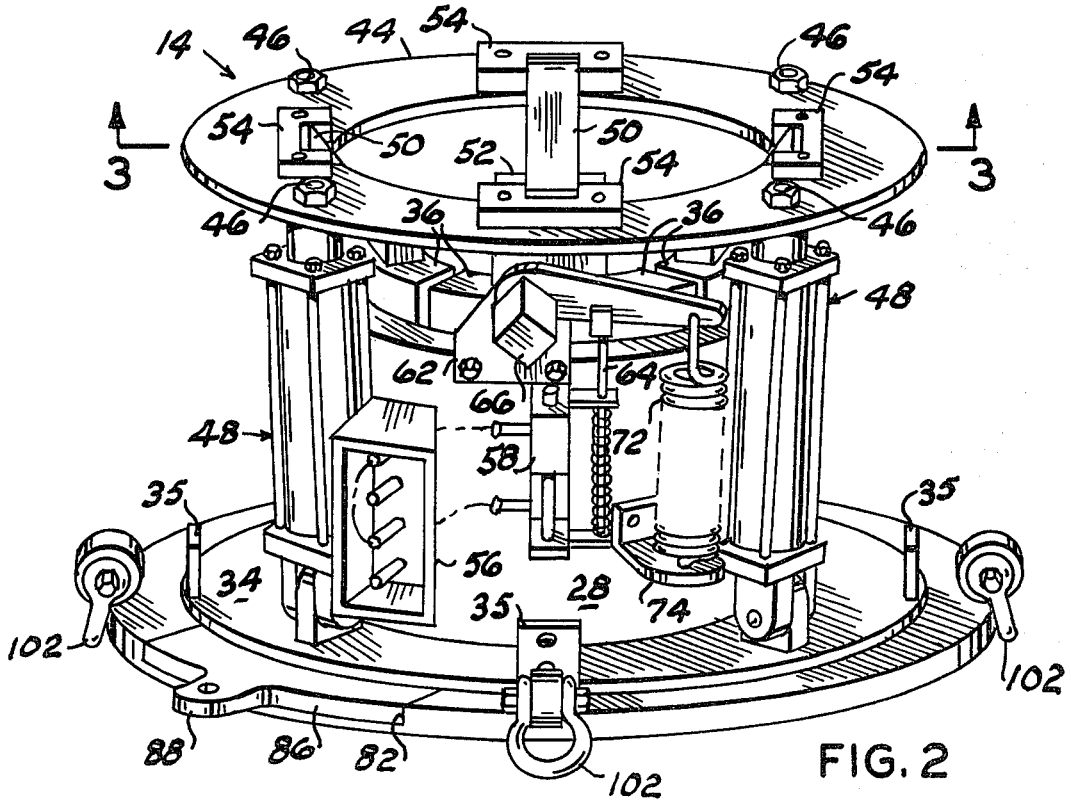
FIG. 2 is a perspective view of the device with the cover removed and the slips in lowered pipe gripping position.
Figure 3:
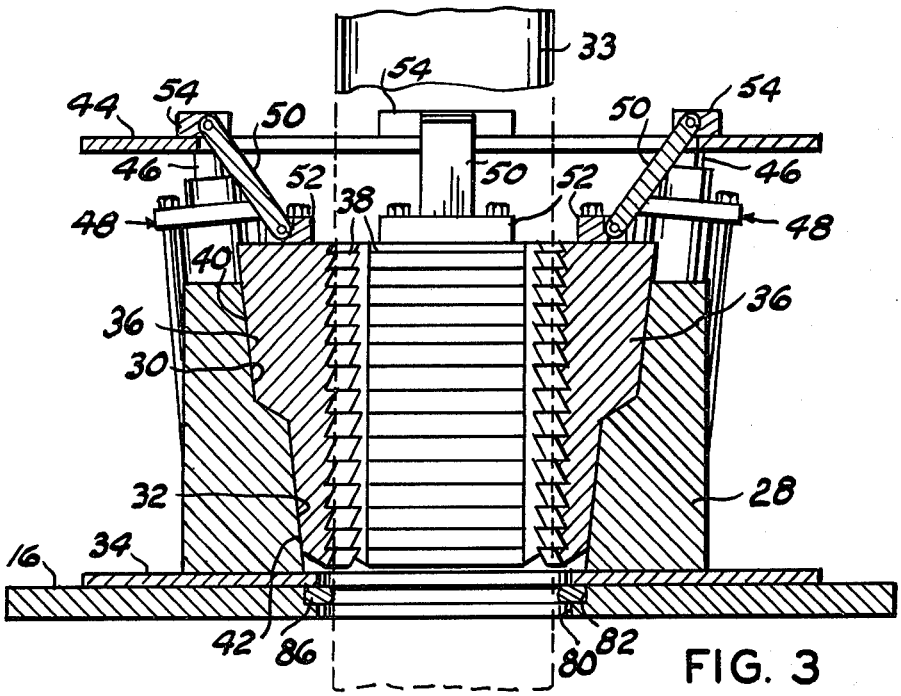
FIG. 3 is a vertical cross sectional view taken substantially along the line 3—3 of FIG. 2.
Figure 5:
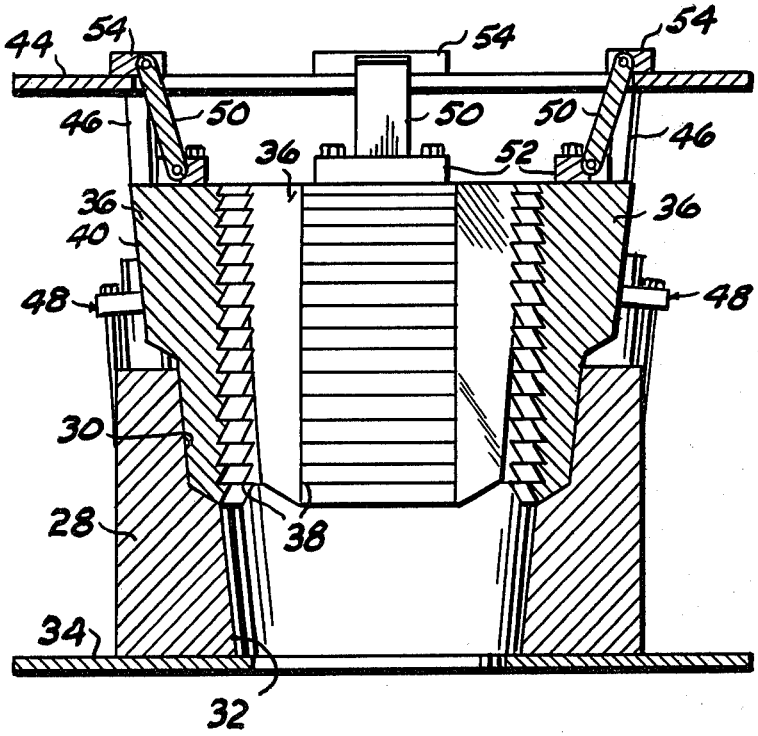
FIG. 5 is a vertical cross sectional view taken substantially along the line 5—5 of FIG. 4; and, FIG. 6 is a perspective view of the underlying pipe guiding support plate illustrating latch tongue movement by dotted lines.

Like characters of reference designate like parts in those figures of the drawings in which they occur.

In the drawings:

The reference numeral 10 indicates the device, as a whole, which is upright cylindrical in general configuration comprising a cover or housing 12 enclosing a spider assembly 14 and overlying a pipe support plate 16. The cover 12 is characterized by a downwardly open cylindrical wall supported by the upper surface of the plate 16 in surrounding relation with respect to the spider assembly 14 and includes a top wall 18 having a central aperture 20 dimensioned for loosely surrounding pipe when inserted therethrough. The cover wall is provided with control access openings 22 and 24 and further includes a pair of apertured ears 26 for lifting the cover off the spider assembly.

The spider assembly 14 comprises a spider 28 having a central step diameter downwardly converging or tapered bore defining an upper seat 30 and a lower smaller diameter seat 32 dimensioned to loosely surround pipe 33 extending into a borehole. The spider 28 coaxially overlies a base ring 34. The base ring 34 is provided with upstanding lugs 35 adjacent its periphery for securing the cover 12 thereto. A plurality of slips 36 are removably received by the tapered bore of the spider in pipe gripping and releasing relation. Each of the slips 36 are characterized by an inward arcuate surface defined by pipe gripping teeth 38 and opposite outer surfaces 40 and 42 cooperatively nested by the step diameter seats 30 and 32 of the spider. A slip ring 44 horizontally overlies the spider 28 in vertically spaced relation and is supported by the pistons 46 of a plurality of pressure cylinders 48 extending in circumferentially spaced relation between the base ring 34 and slip ring 44.

A plurality of strap-like links 50, one for each slip 36, is pivotally connected at one end with lugs 52 secured to the upper end surface of the respective slip and pivotally connected at their other end with a support bar 54 cooperatively mounted on the upper surface of the slip ring 44 for the purpose of raising and lowering the slips 36 into and out of the spider bore in response to actuation of the pressure cylinders 48, as presently explained.

Figure 4:
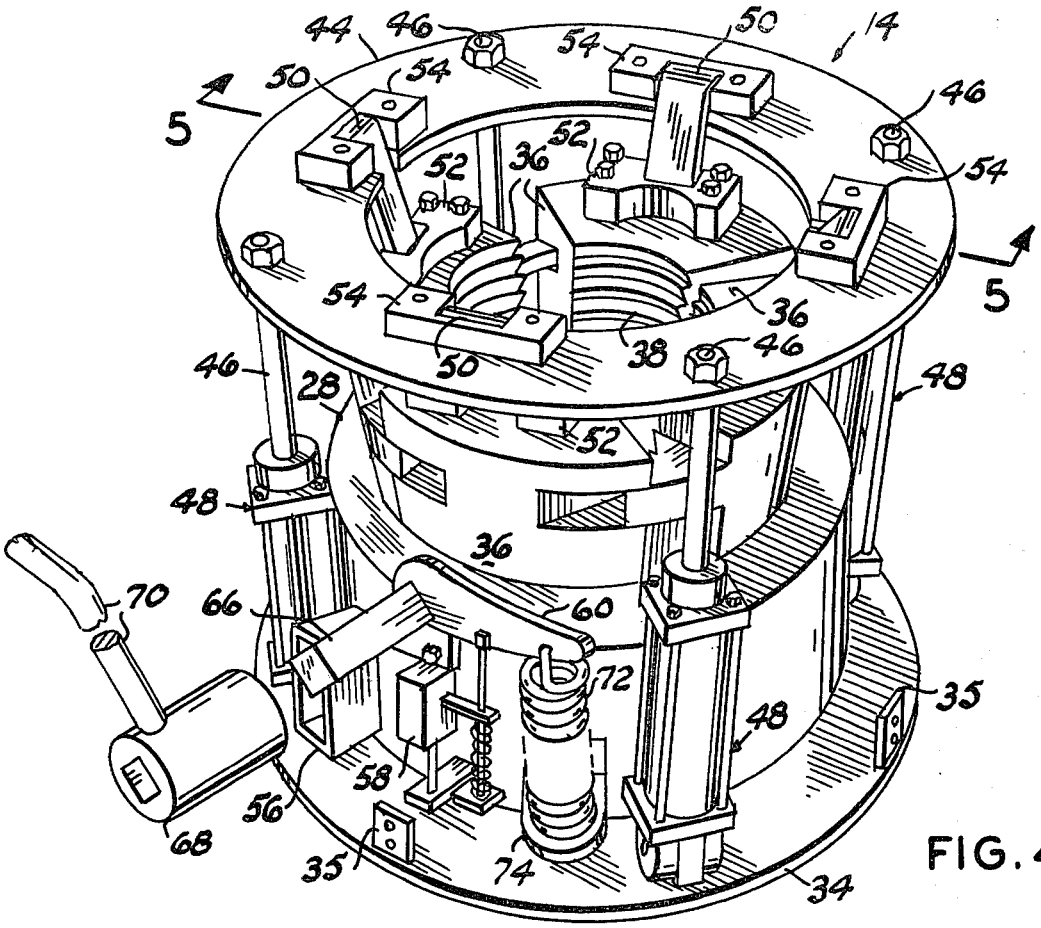
FIG. 4 is a perspective view similar to FIG. 3 with the support plate removed and the slips in raised pipe released relation and illustrating, in exploded relation, a fragment of a manual control handle.

The double acting pressure cylinders 48 are connected with a source of fluid under pressure, not shown, through a distributor 56 and control valve equipped tubing, not shown. A two-way fluid pressure control valve 58 is mounted on the outer wall of the spider 28 and connected with a distributor 56. A lever 60 is pivotally connected at one end with a bracket 62 secured to the spider wall above the valve 58 for vertical pivoting movement of its other end portion. Intermediate its ends, the lever 60 is connected with a rod 64 operatively connected with the valve 58 for actuating the valve 58 to apply slip ring lifting and lowering action to the pressure cylinders 48 in response to vertical movement of the lever 60. At its pivotally connected end, the lever 60 is provided with a laterally projecting shaft 66, square in transverse section, for insertion into a wrench socket 68 (FIG. 4) having an elongated handle 70 for pivoting the lever 60 and opening the valve 58. The lever 60 is normally biased downwardly to a valve closed position by a spring 72, or the like, extending between the end portion of the lever opposite its pivotal connection and an outstanding lug 74 secured to the wall of the spider 28.

Figure 6:
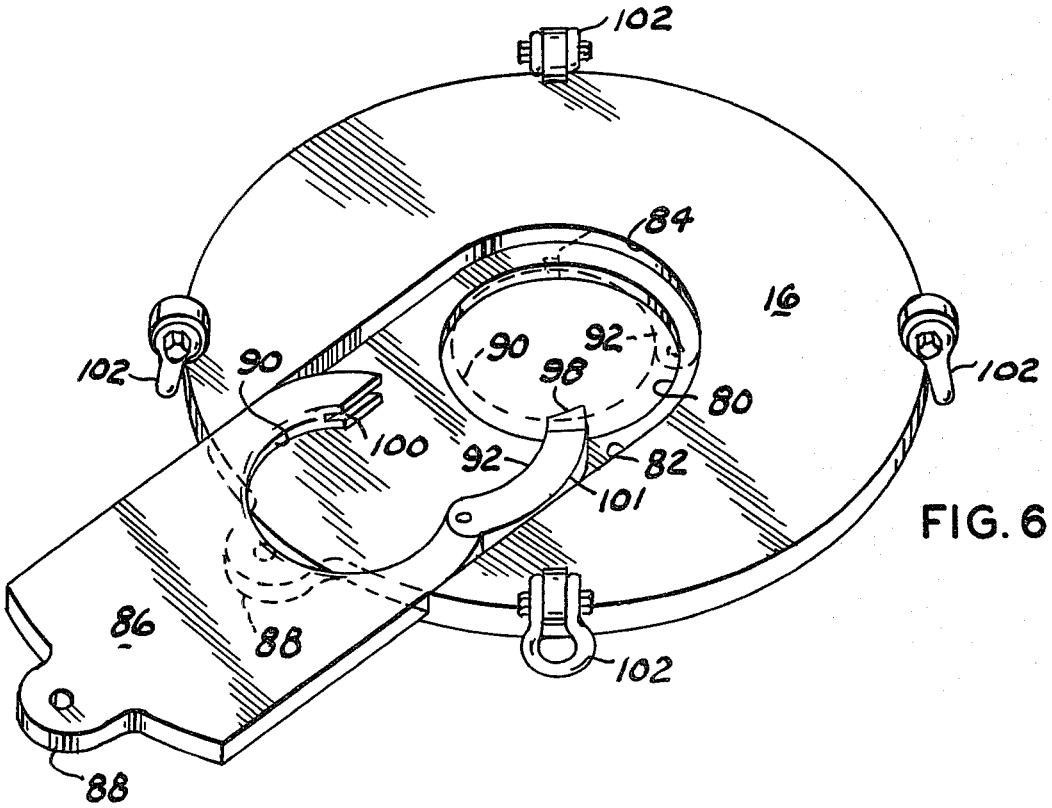

The support plate 16 is relatively thick, for example, 2 inches (5 cm) and is centrally apertured, as at 80, on a diameter at least equal to the bore of the spider 28 and loosely surrounds the pipe 33 to be run through the device 10 in coaxial alignment with the spider assembly 14. The plate 16 is provided with an upwardly open radial slot 82 having an arcuate end portion 84 coaxial with the plate bore 80. The slot 82 slidably receives an elongated tongue 86 having an outwardly projecting apertured ear 88 at one end for longitudinally moving the tongue 86. The other end portion of the tongue is bifurcated and defines a partcircular aperture 90 of smaller diameter than the plate opening 80 dimensioned to freely surround the joint of pipe 33 and permit passage of collars thereon, not shown. The inwardly directed end of the tongue 86 is provided with an arcuate link section 92 pivotally connected at one end with one tongue bifurcation and provided with a lip 94 at its other end snugly received by a groove 100 formed in the other cooperating tongue bifurcation. The purpose of the arcuate link section is to permit movement of the tongue toward the plate opening 80 when the length of pipe 33 is projecting through the assembly 10 wherein the arcuate outer wall 101 of the tongue link 92 engages the plate arcuate groove 84 to pivot the tongue link 92 toward its closed position and surround the length of pipe. Conversely, the tongue 86 may be moved laterally with respect to the pipe and spider assembly 14 by sliding the tongue laterally of the plate within the groove 82 wherein the tongue link 92 pivots to its solid line position of FIG. 6. The plate 16 is further provided with a plurality of loops 102 pivotally connected with its periphery in circumferentially spaced relation for anchoring the plate to a derrick or well floor structure, not shown, to insure coaxial alignment of the plate bore 80 with the well bore, not shown, and for moving the plate to and from axial alignment with the well bore.

Operation

In operation, the support plate 16 is placed on a rig floor, or the like, with its central opening 80 coaxial with the borehole. The plate 16 is anchored in this position by connecting its loops 102 with suitable anchors, such as derrick legs, not shown. The spider assembly 14 and its overlying cover 12 are coaxially disposed on the plate 16. Fluid pressure lines for operating the cylinders 48 are connected with the distributor 56. The plate tongue 86 is normally disposed in its dotted line position of FIG. 6 and thus maintains pipe 33 coaxial with the spider assembly as the pipe is run into or pulled from the well bore. The slips 36 are operated in a conventional manner for supporting or releasing the pipe while adding or removing other joints of pipe with the pipe 33. The tongue 86 thus prevents contact between pipe collars and the slips 36 as the pipe is run into or removed from the borehole. When running or pulling well testing equipment or larger diameter pipe, such as drill collars, not shown, with the pipe 33, the tongue is longitudinally moved to its solid line position of FIG. 6 to expose its walls forming its bore 80 for passage of such equipment. Thereafter, the tongue 86 is moved inwardly to its dotted line position to again assure coaxial alignment of the pipe with the spider assembly.

Obviously the invention is susceptible to changes or alterations without defeating its practicability. Therefore, I do not wish to be confined to the preferred embodiment shown in the drawings and described herein.

I claim:

1. In combination with power operated pipe supporting apparatus coaxially surrounding pipe in a borehole and including a spider having a central downwardly converging slip seat coaxially overlying a base ring and having a plurality of slips pivotally supported by an overlying slip ring and moved vertically into and out of the slip seat in pipe gripping and released relation by a plurality of pressure operated cylinders extending between the base ring and slip ring, the improvement comprising:

a control valve mounted on said spider and operatively connected with said pressure cylinders;

a lever pivotally mounted at one end on said spider for vertical pivoting movement of its other end portion, said lever being operatively connected intermediate its ends with said valve;

a laterally projecting shaft connected with the pivotally connected end of said lever;

a handle engageable with said shaft for moving said lever other end portion vertically; and, pipe guiding plate means having a bore coaxially underlying said base ring for maintaining said pipe coaxial with said spider.

2. The combination according to claim 1 in which said plate means includes:

a plate having an upwardly open radial groove communicating in surrounding relation with its bore and intersecting its periphery;

a plate-like tongue longitudinally slidable within the groove and having a bifurcated inner end portion defining a partcircular inner end surface formed on a smaller radius than the radius of the plate bore; and, an arcuate tongue link pivotally connected at one end with one tongue bifurcation and cooperatively contacting at its other end portion the other tongue bifurcation, said link having an inner surface formed on a radius complemental with the radius of said partcircular surface and having an outer surface complemental with the surface of the groove surrounding the plate bore.

3. In combination with power operated pipe supporting apparatus coaxially surrounding pipe in a borehole and including a spider having a central downwardly converging slip seat coaxially overlying a base ring and having a plurality of slips pivotally supported by an overlying slip ring and moved vertically into and out of the slip seat in pipe gripping and released relation by a plurality of pressure operated cylinders extending between the base ring and slip ring, the improvement comprising:

a plate having a bore coaxially underlying said spider, said plate having an upwardly open radial groove extending inwardly from its periphery and communicating in surrounding relation with the plate bore;

a plate-like tongue longitudinally slidable within the groove and having a bifurcated inner end portion defining a partcircular inner end surface formed on a smaller radius than the radius of the plate bore; and, an arcuate tongue link pivotally connected at one end with one tongue bifurcation and cooperatively contacting at its other end portion the other tongue bifurcation, said link having an inner surface formed on a radius complemental with the radius of said partcircular surface and having an outer surface complemental with the surface of the groove surrounding the plate bore.

4. The combination according to claim 3 and further including:

a plurality of anchor loops connected with the periphery of said plate for preventing lateral movement of said plate.

* * * * *